US010232970B2

(12) United States Patent
Verma

(10) Patent No.: US 10,232,970 B2
(45) **Date of Patent: *Mar. 19, 2019**

(54) HOLD-OPEN DEVICE AND PACKAGE HAVING SAME

(71) Applicant: PROAMPAC INTERMEDIATE, INC., Cincinnati, OH (US)

(72) Inventor: Vishaal Boehm Verma, Evanston, IL (US)

(73) Assignee: ProAmpac Intermediate, Inc., Cincinnati, OH (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/358,749

(22) Filed: Nov. 22, 2016

(65) Prior Publication Data

US 2017/0137161 A1 May 18, 2017

Related U.S. Application Data

(63) Continuation-in-part of application No. 14/259,868, filed on Apr. 23, 2014, now Pat. No. 9,499,291.

(Continued)

(51) Int. Cl.
*B65D 67/00* (2006.01)
*B65B 67/12* (2006.01)

(Continued)

(52) U.S. Cl.
CPC ..... *B65B 67/1255* (2013.01); *B65B 67/1205* (2013.01); *B65B 67/125* (2013.01);

(Continued)

(58) Field of Classification Search
CPC ..... B32B 67/1255; B32B 67/1205; B32B 67/125; B65D 33/007; B65D 33/02; B65D 33/2508; B65D 33/30

(Continued)

(56) References Cited

U.S. PATENT DOCUMENTS 199,507 A 1/1878 Brubaker
1,463,113 A 7/1923 Bibb (Continued)

FOREIGN PATENT DOCUMENTS

EP 2112085 10/2009
GB 26598 11/1898

(Continued)

OTHER PUBLICATIONS

U.S. Office Action, U.S. Appl. No. 13/786,068, dated Apr. 13, 2015, (26 pages).

(Continued)

*Primary Examiner* — Peter Helvey
(74) *Attorney, Agent, or Firm* — Perman & Green, LLP

(57) ABSTRACT

A device for selectively retaining a package opening in a gaping configuration and a package including the device applied to a package body. The device includes a circumferential strip with side seams formed as vertical or longitudinal hinges. One or more tabs extend in a first axial direction from an upper edge of the circumferential strip at the side seams. Each tab is coupled to the circumferential strip with a horizontal or transverse hinge. The tabs are pivotable about the horizontal or transverse hinges in opposite directions away from the opening axis to respective folded-out positions, which inhibits the device from folding at the side seams and retains a gaping open configuration of the device and package. The vertical hinges include thru cuts or line of perforations that go through the entire material thickness of the circumferential strip and the one or more tabs and extend for a majority of the full axial length of the device. The horizontal hinges may be in the form of a living hinge or alternatively thru cuts or a line of perforations.

74 Claims, 10 Drawing Sheets

Related U.S. Application Data

(60) Provisional application No. 61/815,252, filed on Apr. 23, 2013.

(51) Int. Cl.

| | |
|---|---|
| ***B65D 33/02*** | (2006.01) |
| ***B65D 33/30*** | (2006.01) |
| ***B65D 33/00*** | (2006.01) |
| ***B65D 33/25*** | (2006.01) |

(52) U.S. Cl.
CPC ..... *B65D 33/007* (2013.01); *B65D 33/02* (2013.01); *B65D 33/2508* (2013.01); *B65D 33/30* (2013.01)

(58) Field of Classification Search
USPC ..... 383/34
See application file for complete search history.

(56) References Cited

U.S. PATENT DOCUMENTS

| | | | |
|---|---|---|---|
| 1,887,940 | A | 11/1932 | Marinsky |
| 2,008,314 | A | 7/1935 | Russell |
| 2,040,271 | A | 5/1936 | Rosenzweig |
| 2,074,843 | A | 3/1937 | Hiering |
| 2,142,904 | A | 1/1939 | Lamarth |
| 2,150,627 | A | 3/1939 | Lieber |
| 2,693,212 | A | 11/1954 | Guichard |
| 3,189,253 | A | 6/1965 | Mojonnier |
| 3,310,224 | A | 3/1967 | Laguerre |
| 3,313,469 | A | 4/1967 | Drozda |
| 4,069,994 | A | 1/1978 | Wharmby |
| 4,486,923 | A | 12/1984 | Briggs |
| 4,664,348 | A | 5/1987 | Corsaut, III et al. |
| 4,753,367 | A | 6/1988 | Miller et al. |
| 4,753,489 | A | 6/1988 | Mochizuki et al. |
| 4,758,099 | A | 7/1988 | Branson |
| 4,815,866 | A | 3/1989 | Martone |
| 4,848,930 | A | 7/1989 | Williams et al. |
| 5,037,138 | A | 8/1991 | McClintock et al. |
| 5,044,774 | A | 9/1991 | Bullard et al. |
| 5,082,219 | A | 1/1992 | Blair |
| 5,183,227 | A | 2/1993 | Wilhite |
| 5,184,896 | A | 2/1993 | Hammond et al. |
| 5,524,990 | A | 6/1996 | Buck |
| 5,609,419 | A | 3/1997 | Byers, Jr. |
| 5,676,306 | A | 10/1997 | Lankin et al. |
| 5,716,138 | A | 2/1998 | Southwell |
| 6,022,144 | A | 2/2000 | Hausslein |
| 6,139,187 | A | 10/2000 | Galomb et al. |
| 6,149,304 | A | 11/2000 | Hamilton et al. |
| 6,164,821 | A | 12/2000 | Randall |
| 6,231,235 | B1 | 5/2001 | Galomb et al. |
| 6,234,674 | B1 | 5/2001 | Byers, Jr. |
| 6,234,676 | B1 | 5/2001 | Galomb et al. |
| 6,273,608 | B1 | 8/2001 | Ward, Jr. et al. |
| 6,345,911 | B1 | 2/2002 | Young et al. |
| 6,508,587 | B1 | 1/2003 | Byers, Jr. |
| 6,572,267 | B1 | 6/2003 | Forman |
| 6,578,585 | B1 | 6/2003 | Stachowski et al. |
| 6,678,923 | B2 | 1/2004 | Goldberg et al. |
| 6,899,460 | B2 | 5/2005 | Turvey et al. |
| 6,904,647 | B2 | 6/2005 | Byers, Jr. |
| 7,347,623 | B2 | 3/2008 | Cawley |
| 7,416,337 | B2 | 8/2008 | Munch-Fals |
| 7,681,784 | B2 | 3/2010 | Lang |
| 8,333,351 | B2 | 12/2012 | Kramer |
| 8,678,650 | B2 | 3/2014 | Savage |
| 2003/0033694 | A1 | 2/2003 | Cisek |
| 2004/0195467 | A1 | 10/2004 | Passage |
| 2004/0208400 | A1 | 10/2004 | Linneweil |
| 2005/0137073 | A1 | 6/2005 | Weaver |
| 2005/0281487 | A1 | 12/2005 | Pawlowski et al. |
| 2006/0010659 | A1 | 1/2006 | Penn |
| 2006/0050999 | A1 | 3/2006 | Blythe et al. |
| 2006/0280386 | A1 | 12/2006 | Bublitz |
| 2008/0019618 | A1 | 1/2008 | Dayton et al. |
| 2009/0046955 | A1 | 2/2009 | Schember et al. |
| 2011/0188785 | A1 | 8/2011 | Turvey et al. |
| 2011/0226914 | A1 | 9/2011 | Fleming |
| 2012/0138623 | A1 | 6/2012 | Verma |
| 2013/0064480 | A1 | 3/2013 | Verma |
| 2013/0248541 | A1 | 9/2013 | Verma |
| 2014/0014789 | A1 | 1/2014 | Verma |

FOREIGN PATENT DOCUMENTS

| | | |
|---|---|---|
| JP | 51017122 | 2/1976 |
| JP | 2000085905 | 3/2000 |
| JP | 2003072779 | 3/2003 |
| WO | 9900312 | 1/1999 |

OTHER PUBLICATIONS

International Search Report and Written Opinion, International Application No. PCT/US2012/068314, dated Mar. 14, 2013 (6 pages).

International Search Report and Written Opinion, International Application No. PCT/US2011/062840, dated Apr. 23, 2012 (6 pages).

U.S. Office Action, U.S. Appl. No. 12/958,217, dated Nov. 6, 2012 (8 pages).

U.S. Office Action, U.S. Appl. No. 12/958,217, dated Apr. 12, 2013 (10 pages).

U.S. Office Action, U.S. Appl. No. 13/485,773, dated Nov. 14 3 (13 pages).

International Search Report and Written Opinion, International Application No. PCT/US2014/035154, dated Aug. 29, 2014, (7 pages).

Impact Advanced Concepts, "Snap-Span", earliest available publication Apr. 8, 2012, https://web.archive.org/web/20120408231153/http://www.snap-span.com/ downloaded Oct. 5, 2016 (2 pages).

Jokari, "Baggy Rack Pro" earliest avaiable publication Nov. 15, 2012 https://web.archive.org/web/20121115010901/http://www.jokari.com/products/G_169606.html downloaded Oct. 5, 2016 (1 page).

European Search Report, European Application No. 14788559, dated Nov. 16, 2016.

HOLD-OPEN DEVICE AND PACKAGE HAVING SAME

CROSS-REFERENCE TO RELATED APPLICATIONS

This application is a continuation-in-part of U.S. patent application Ser. No. 14/259,868 filed on Apr. 23, 2014, (now U.S. Pat. No. 9,499,291) and claims the benefit of and priority from U.S. Provision Patent Application No. 61/815,252, filed on Apr. 23, 2013, the disclosures of which are incorporated herein by reference in their entireties.

BACKGROUND

The present invention relates to containers, such as flexible packages with re-sealable openings, and furthermore, to devices for holding such packages open.

Pliable containers are widely used to store both edible and non-edible products. For example, snack items, such as various types of chips and cereals, are typically packaged in pliable containers. These containers are generally sealed at both ends for initial packaging purposes and then one end is opened to access the product. Although flexible enough to allow the open end to assume a gaping open configuration, generally from a flat closed configuration, such containers may spring back to a closed or mostly-closed configuration when not held open. This may be especially true where the container is a package constructed of flexible sides coupled together at a pair of longitudinal or vertical side seams. Such packages often include zip-type closures for creating a reusable air tight seal at the open end of the package or container. Although these configurations often make repeated opening and closing of the package simple and convenient, the flexible nature of both the package and zip-type closure make it difficult to maintain the package in an open configuration such that the side walls of the package are widely separated making it easy to access withheld contents.

SUMMARY

In one aspect, the invention provides a device for selectively retaining a package opening in a gaping configuration. A circumferential strip is configured to be secured to a package opening, the circumferential strip defining an opening axis. A pair of side seams are formed as vertical hinges, wherein the pair of side seams define opposed first and second ends of the device. The device is divided by the pair of side seams into first and second sides. A pair of tabs extend in a first axial direction from an upper edge of the circumferential strip, with one of the pair of tabs being positioned at each of the opposed first and second ends of the device and each one of the pair of tabs being coupled to the circumferential strip with a horizontal hinge. The pair of tabs are pivotable about the horizontal hinges in opposite directions away from the opening axis to respective folded-out positions. Each one of the pair of side seams intersects a corresponding one of the horizontal hinges of the pair of tabs such that folding of the device at the side seams inhibits pivoting of the pair of tabs to the respective folded-out positions, and folding of the device at the side seams is inhibited to retain a gaping open configuration of the device when the pair of tabs are in the respective folded-out positions. The vertical hinges include thin cuts or a line of perforations that go through (also alternatively referred to as "cut through" or "pass through") the entire material thickness of the adjacent portion of the circumferential strip and the pair of tabs and also extend for a majority of the full axial length of the device, from upper ends of the pair of tabs to a lower end of the circumferential strip.

In another aspect, the invention provides a package including a package body having flexible sides, a closed end, an openable end, and a pair of side seams, and a device for selectively retaining the openable end of the package body in a gaping configuration. The device includes a circumferential strip secured to the package body at the openable end. The circumferential strip defines an opening axis coaxial with a package body axis. A pair of side seams are aligned with the pair of side seams of the package body, and the pair of side seams are formed by vertical hinges. A pair of tabs extend in a first axial direction from an upper edge of the circumferential strip. One of the pair of tabs extends across each one of the side seams of the device. Each one of the pair of tabs is coupled to the circumferential strip with a horizontal hinge. The pair of tabs are pivotable in opposite directions away from the opening axis about the horizontal hinges to respective folded-out positions. The vertical hinges include thru cuts or a line of perforations that go through (also alternatively referred to as "cut through" or "pass through") the entire material thickness of the adjacent portion portions of the circumferential strip and the pair of tabs and also extend for a majority of the full axial length of the device, from upper ends of the pair of tabs to a lower end of the circumferential strip. Each one of the pair of side seams intersects a corresponding one of the horizontal hinges of the pair of tabs such that folding of the device at the side seams inhibits pivoting of the pair of tabs to the respective folded-out positions, and folding of the device at the side seams is inhibited to retain a gaping open configuration of the device when the pair of tabs are in the respective folded-out positions. As such, the package is operable in at least two configurations including: a first configuration in which the device is folded upon its side seams and the openable end of the package body can be closed, and a second configuration in which the pair of tabs are both folded outward away from the opening axis about the respective horizontal hinges to inhibit closing of the openable end of the package body.

In yet another aspect, the invention provides a device for selectively retaining a package opening in a gaping configuration; the device includes a strip portion configured to be secured to a package opening, and at least one tab extending from the strip portion. A longitudinal or vertical hinge portion divides the strip portion and the tab into two sides and allows the two sides to be folded together about the longitudinal or vertical hinge portion. The longitudinal or vertical hinge portion includes thru cuts or a line of perforations that go through (also alternatively referred to as "cut through" or "pass through") the entire material thickness of the adjacent strip portion and the adjacent at least one tab and also extend for a majority of the full axial length of the device, from upper end of the at least one tab to a lower end of the strip portion. A transverse or horizontal hinge portion couples the tab to the strip portion and intersects the longitudinal or vertical hinge portion, allowing the tab to pivot from a longitudinal or vertical orientation generally aligned with the strip portion to a folded-out position that is angled out of alignment from the strip portion. The transverse or horizontal hinge portion includes a living hinge located at a radially outward side of the device and formed by a blind slit from a radially inward side of the device or alternatively the transverse or horizontal hinge portion includes thru cuts or a line of perforations that go through (also alternatively referred to as "cut through" or "pass through") the entire material thickness of the adjacent strip portion and the at least one tab. Folding of the device along the longitudinal or vertical hinge inhibits pivoting of the tab to the folded-out position, and folding of the device along the longitudinal or vertical hinge is inhibited when the tab is in the folded-out position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. All numerical values within the detailed description and the claims herein are modified by "about" or "approximately" the indicated value, and take into account experimental error and variations that would be expected by a person having ordinary skill in the art.

FIGS. 1-6 illustrate a device 20 which can hold open a package. While the hold-open device 20 can maintain a package opening in a gaping configuration as described in further detail below, the device 20 also allows the package opening to be closed without significant resistance and without removing the device 20 from the package. Although shown as part of a package in additional drawings and described below, the structure of the hold-open device 20 is first described with reference to FIGS. 1-6.

Figure 1:
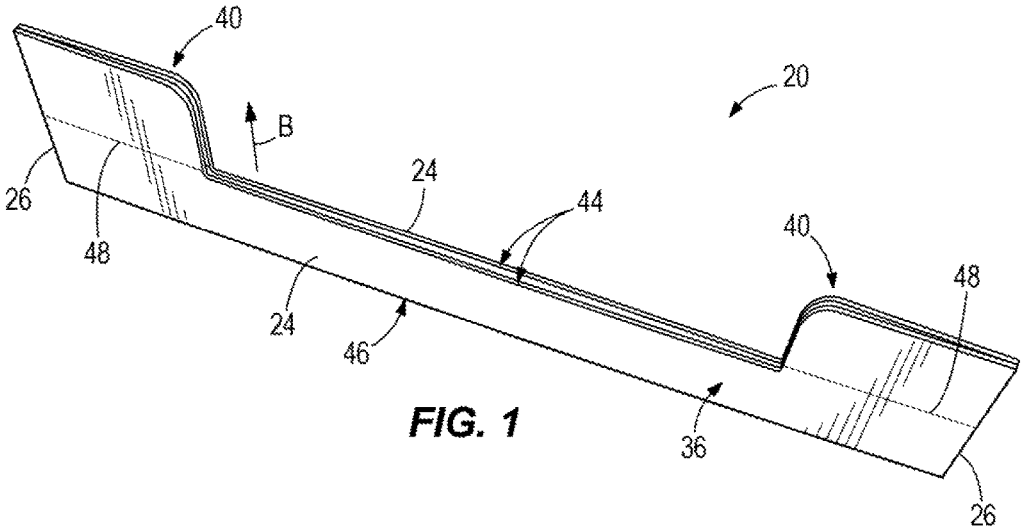
FIG. 1 is a perspective view of a hold-open device according to one construction, shown in a closed configuration.
Figure 2:
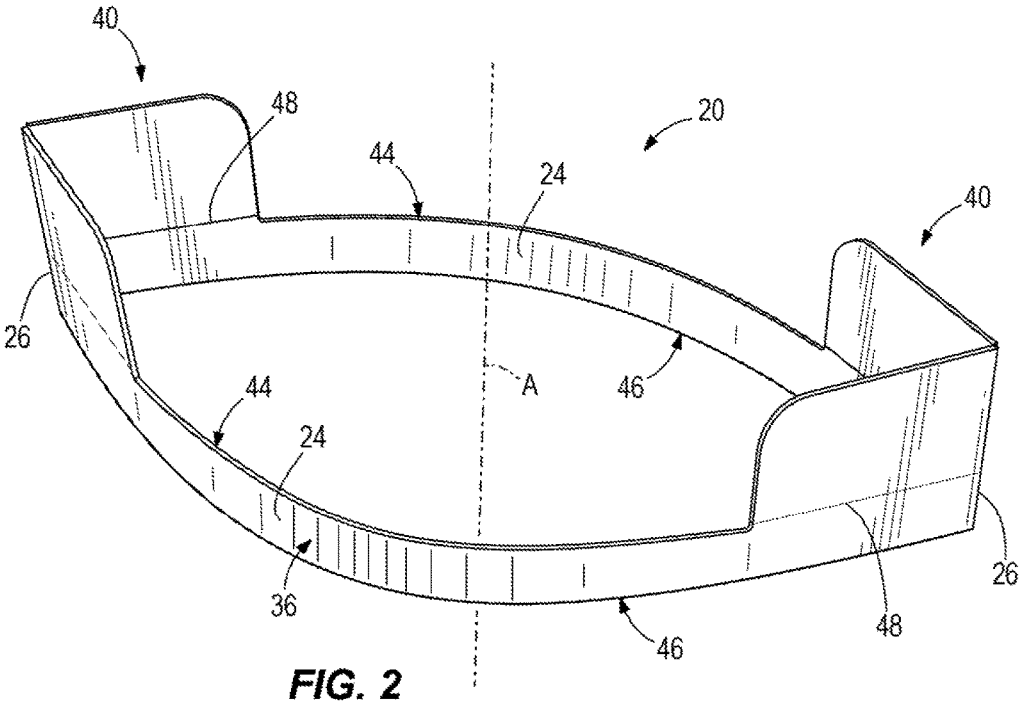
FIG. 2 is a perspective view of the hold-open device of FIG. 1, shown in an intermediate open configuration.
Figure 3A:
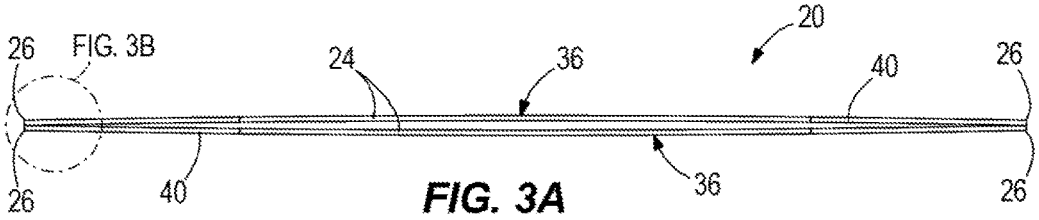
FIG. 3A is a top view of the hold-open device of FIG. 1, shown in the closed configuration.
Figure 3B:
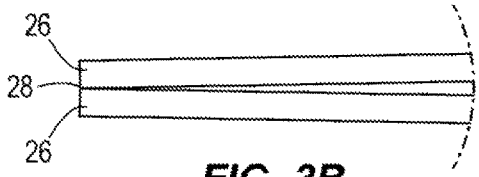
FIG. 3B is a detail view of an end portion of the hold-open device as shown in FIG. 3A.
Figure 4A:
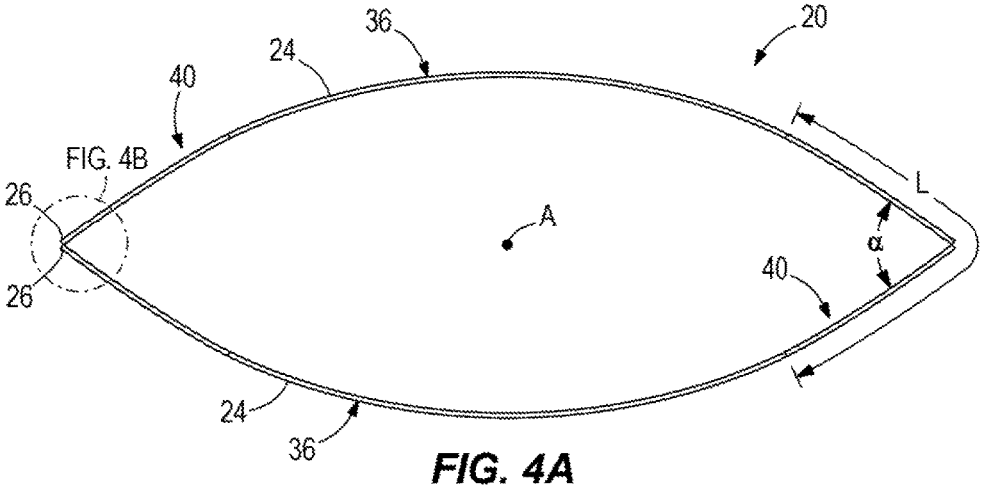
FIG. 4A is a top view of the hold-open device of FIG. 1, shown in the intermediate open configuration and illustrating living hinge connections.
Figure 4B:
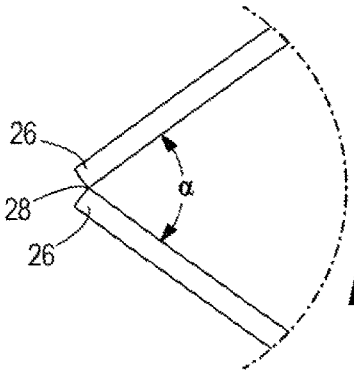
FIG. 4B is a detail view of an end portion of the hold-open device as shown in FIG. 4A.

The hold-open device 20 includes a circumferential strip provided by two side portions 24 coupled together at their ends 26 by two hinge portions 28. The two hinge portions 28 may also be referred to as longitudinal or vertical hinges. The side portions 24 can be of substantially equal length such that the hinge portions 28 are positioned at two opposing ends of the device 20. The hinge portions 28 are configured to allow the two side portions 24 to lie directly against one another along their entire length to define a closed configuration as shown in FIGS. 1 and 3A. An opening angle $\alpha$ between the two side portions 24, as defined in FIGS. 4A and 4B, may be approximately 0 degrees when in the closed configuration. The hinge portions 28 also allow the two side portions 24 to be separated, with each of the side portions 24 assuming (i.e., flexing into) a generally arcuate shape as shown in FIGS. 2, 4A, and 4B. The hinge portions 28 may enable the device 20 to be opened to any opening angle $\alpha$ above 0 degrees up to about 180 degrees or about 30 degrees, or about 60 degrees, or about 90 degrees, or about 120 degrees, or about 150 degrees. In this way, the hinge portions 28 define side seams that extend parallel to a central axis A of the device 20 defined, when open, as shown in FIG. 2. While orientation is not critical, this may be referred to as the vertical or longitudinal direction for convenience. Although the central axis A may not be the center of the arc or curvature of either of the side portions 24, which themselves may have multiple different arc portions, the central axis A is defined as the point midway across a virtual line that extends between the two ends 26.

The two side portions 24 forming the circumferential strip are constructed from a flexible material. In some constructions, the construction includes integrally molding as a ring from a flexible thermoplastic polymer material. In other constructions, the circumferential strip may be formed by bonding together (e.g., via a heat seal, solvent weld, etc.) two opposing ends of a finite length or strip of material cut from a continuous tape feed. For example, such a bond 32 can be formed at an intermediate position of one of the side portions 24 as shown in the alternate constructions of FIGS. 10 and 11. The tab fitment device 20 described herein may be alternatively made from a single piece with distal ends via injection molding or extrusion followed by die cutting. The tab fitment device 20 made from a single piece with distal ends would be folded about the longitudinal or vertical hinges 28 and the distal ends would then be joined to form a bond 32 by any method known in the art including, but not limited to, adhesive bonding, heat sealing, spot sealing and sonic welding. Whether molded or bonded into ring form, the two side portions 24 and the hinge portions 28 can be made of a polyolefin material, including for example, polypropylene, polyethylene, polybutene or any blend thereof. Although the device 20 can be entirely or primarily formed of polyolefin material, additional fillers and/or plasticizers may be optionally added. As described in further detail below, the circumferential strip can be secured or fixed to a package body (e.g., adjacent an opening thereof) to selectively control the configuration of the opening. The circumferential strip is provided with a radially outward facing surface 36 on both of the side portions 24 for securement with a package body. As best shown in FIG. 4B, the hinge portions 28 connecting the two side portions 24 are formed as blind slits in the radially outward side to separate or interrupt the radially exterior surfaces 36. In other words, the hinge portions 28 are positioned at or adjacent a radially innermost side of the side portions 24. The hinge portions 28 may form a continuous radially inner surface between the adjacent side portions 24. When provided as living hinges, the hinge portions 28 can be integrally formed as a single piece with both of the adjacent side portions 24, as a reduced-thickness portion of the material. The hinge portions 28 can be formed by a slitting operation performed after molding in some constructions. Alternately, the hinge portions 28 can be formed by die cutting, or directly in an injection molding process, or laser engraving process, among other possible techniques. The vertical or longitudinal hinge portions 28 can have a material thickness less than 80 percent of a material thickness of the adjacent portions of the circumferential strip. In some constructions, the hinge portions 28 can have a material thickness that is 70 percent or less, 60 percent or less, 50 percent or less, 40 percent or less, or 30 percent or less, 25 percent or less, or 20 percent or less, or 10 percent or less, or 5 percent or less of a material thickness of the adjacent portions of the circumferential strip. The material thickness of the vertical or longitudinal hinge portions 28 can be between about 0.001 inch and about 0.040 inch (e.g., about 0.0254 mm to about 1.016 mm), or about 0.005 inch and about 0.030 inch (e.g., about 0.127 mm to about 0.762 mm), or about 0.010 inch and about 0.020 inch (e.g., about 0.254 mm to about 0.508 mm) in some constructions. In some constructions, the hinge portions 28 are provided by a separate material and/or multi-piece hinge mechanism coupled between the side portions 24. However, the vertical or longitudinal hinge portions 28 may be provided as any portion that enables folding, bending, or pivoting. For example, the vertical or longitudinal hinge portions 28 may be provided by only a fold or crease in the material.

Figure 7:
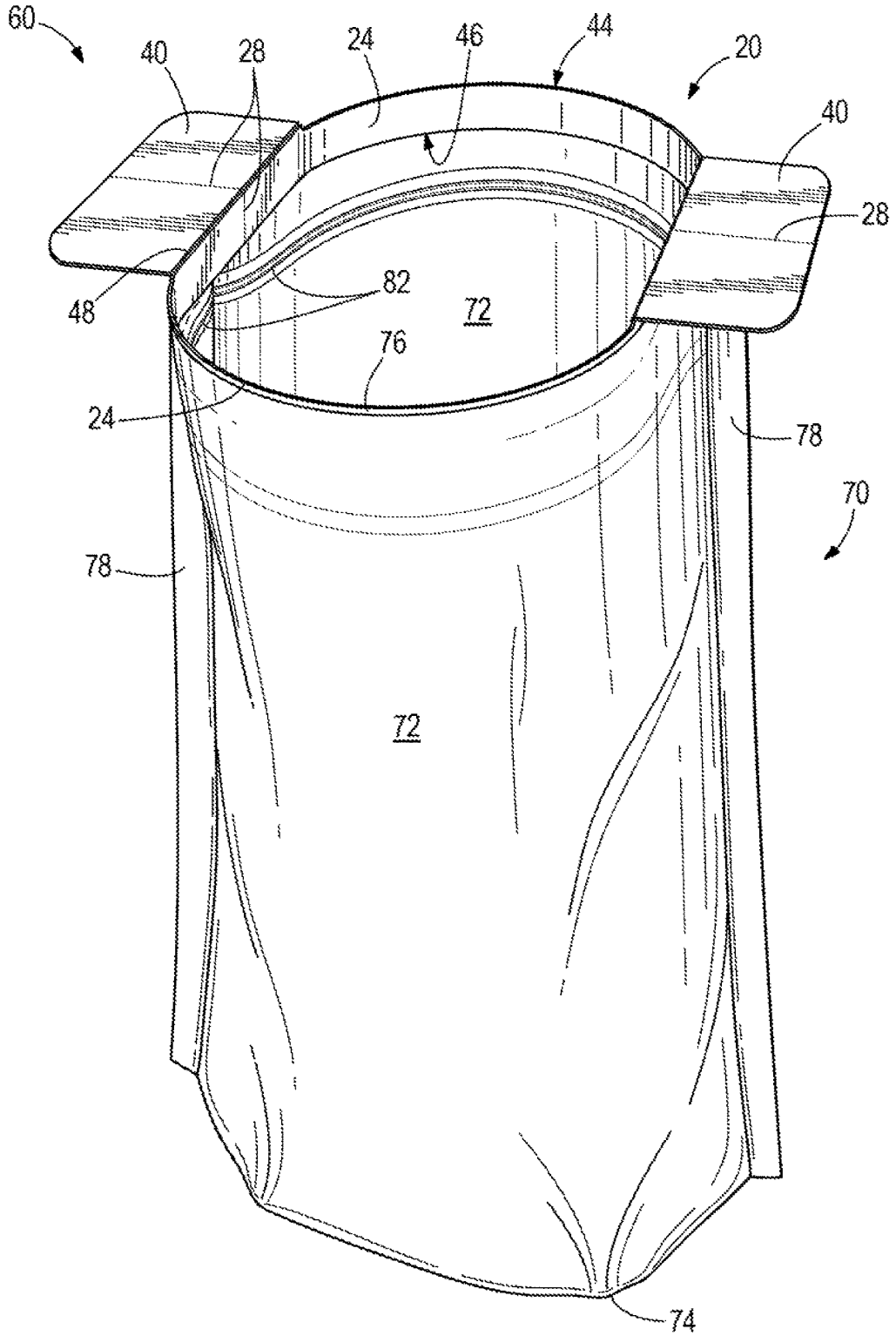
FIG. 7 is a perspective view of a package including the hold-open device of FIGS. 1-6 mounted in an opening of the package body.
Figure 10:
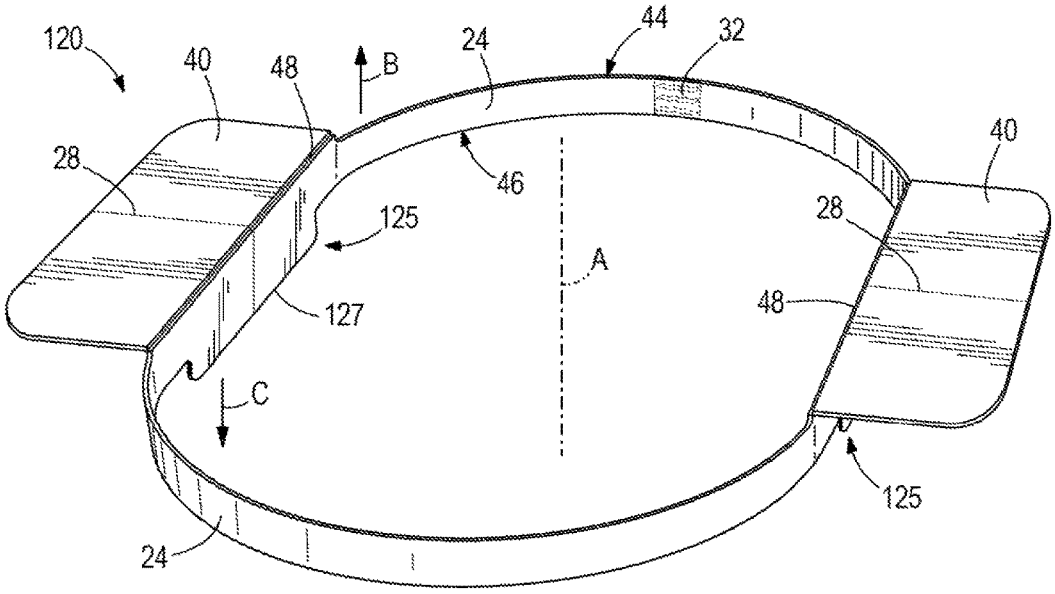
FIG. 10 is a perspective view of a hold-open device according to another construction.

In one form, the longitudinal or vertical hinge portions 28 may have a cut length that is equal to that the height of the tabs 40 and the height of the circumferential strip 24 (as for example in FIGS. 7 and 10). That is the longitudinal or vertical living hinge or blind slit transverses the entire height of the tabs 40 and the circumferential strip 24. In another form, the longitudinal or vertical hinge portions 28 may have a cut length for the blind slit or vertical living hinge 28 that is less than the height of the tabs 40 and the height of the circumferential strip 24. For example, there may be uncut areas (as shown by 27, 29 in FIG. 12) at the top of the tab 40 and at the bottom of the circumferential strip 24 when used with vertical living hinge or blind slit of FIG. 7 and FIG. 10.

Figure 12A:
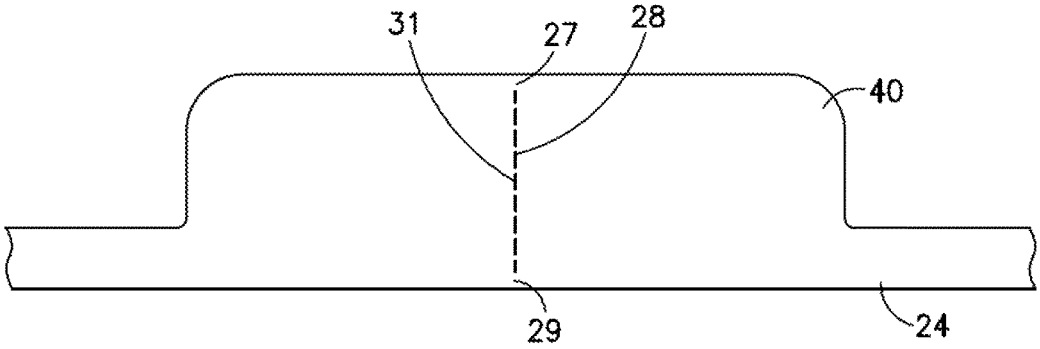
FIG. 12(*a-c*) is a top view of the hold open device depicting alternative designs for the longitudinal or vertical hinge portion of the device.
Figure 12B:
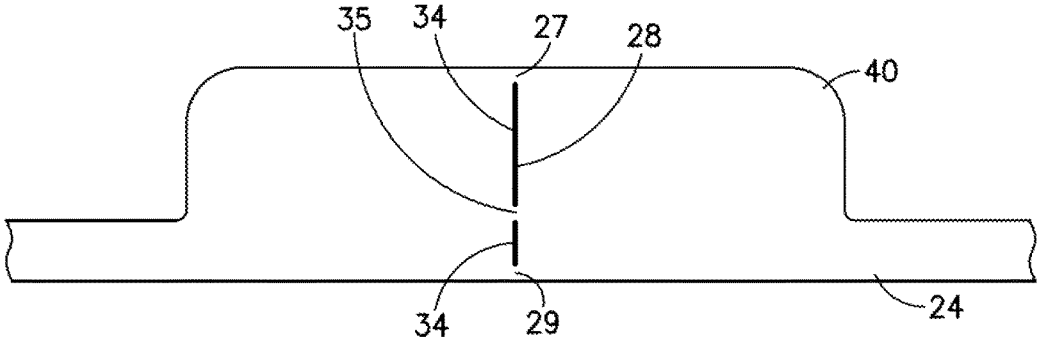
Figure 12C:
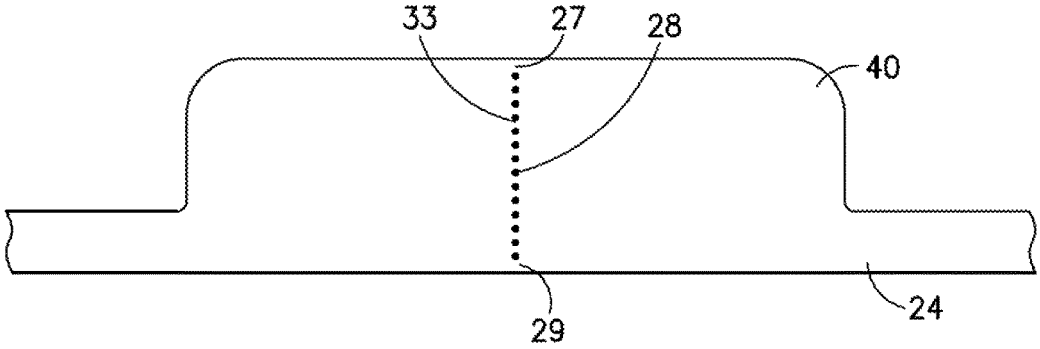

Referring to FIG. 12, in an alternative form, the hinge portions 28 (also referred to as longitudinal or vertical hinges) may be in the form of a line of perforations (31 in FIG. 12*a*) or thin cuts (34 in FIG. 12*b*) that goes through (also alternatively referred to as "cuts through" or "passes through") the entire material thickness of the adjacent portion portions of the circumferential strip 24 and the one or more tabs 40. The line of perforations 31 is a series or multitude of cuts in a line that go through the entire material thickness of the adjacent portion portions of the circumferential strip 24 and the one or more tabs 40 and may be in the form of dotted lines (33 in FIG. 12*c*), dashed lines (31 in FIG. 12*a*) or any other form that produces a segment or series of perforations in the material to form the hinge portions 28. The thru cuts 34 are distinguished from the line of perforations 31 in being fewer longer cuts (typically two cuts 34 with an uncut section 35 in between the two cuts 34) in the material as opposed to shorter more frequent cuts with uncut regions in between for the line of perforations 31. The thru cuts 34 similarly go through the entire material thickness of the adjacent portion portions of the circumferential strip 24 and the one or more tabs 40. The thru cuts 34 or line of perforations 31, 33 may be applied for a majority of the height or length of the hinge portions 28 with the height or length being the distance from the top of the tab 40 to the bottom of the strip 24. A majority of the height means that at least 50%, or at least 60%, or at least 70%, or at least 80%, or at least 90% of the height or length of the vertical hinge portions 28 or side seams (full axial length of the device) are perforated, cut or scored through the entire material thickness of the circumferential strip 24 and the one or more tabs 40. In order to maintain the integrity of the vertical hinge portions against tearing or breaking, the top 27 and bottom 29 of the vertical hinge portions 28 are not cut, scored or perforated. Hence, the top 27 and bottom 29 of the vertical hinge portions 28 includes uncut material 27, 29 at each end of the vertical hinge portions 28. The portion of uncut material 27, 29 at each end of the vertical hinge portions 28 may have an uncut length of less than or equal to 5 mm, or less than or equal to 4 mm, or less than or equal to 3 mm, or less than or equal to 2 mm, or less than or equal to 1 mm, or less than or equal to 0.75 mm, or less than or equal to 0.5 mm. This uncut material 27, 29 at each end of the vertical hinge portions 28 provides strength and reinforcement to the vertical hinge portions 28 by preventing the vertical hinge portions 28 from tearing when being flexed when the device and package opening is moved back and forth between the open and closed configuration. The relatively narrow height or length of the uncut material 27, 29 at each end of the vertical hinges also still allows the vertical hinge portions 28 to freely rotate.

This alternative form of the longitudinal or vertical hinge portions 28 including two thru cuts 34 or a line of perforations 31 provides for at least one of the following advantages: ease of manufacturing and enhanced performance of the longitudinal or vertical hinge portions 28 relative to a blind slit or living hinge design. With regard to the ease of manufacturing, using two thru cuts or a line of perforation design for the vertical hinges 28, a single tool may be used to produce both the vertical hinges and horizontal hinges because both may be cut from the same side of the fitment or device. With regard to the enhanced performance of the hinge portions 28, the thru cuts 34 or line of perforations 31 provides for an effective means to tailor the force required for folding, bending, or pivoting of the vertical hinge portions 28. The thru cuts 34 or line of perforations 31 that form the vertical hinge portions 28 may be formed by die cutting, or directly in an injection molding process, or laser engraving process, among other possible techniques.

Where the ends 26 of the side portions 24 meet at each of the side seams, the device 20 further includes a tab 40 that extends from the circumferential strip (i.e., from an upper edge 44 of the circumferential strip). The tabs 40 are thus positioned at opposite ends of the device 20 as shown in the drawings, and both extend from the circumferential strip in a common first direction B, which is substantially parallel to the central axis A when the device 20 is in the closed or partially open configurations of FIGS. 1-4B. The first direction B can define an upward or outward direction that extends opposite a base end 46 of the circumferential strip, which is configured to be positioned furthest into a package opening. As described in further detail below, most or all of each tab 40 may extend outwardly past the end of a package when secured thereto. The tabs 40 are positioned so that each spans across a corresponding one of the side seams. Although other constructions may be optional, each of the tabs 40 has a length L in the circumferential direction which is centered about the respective side seam. The lengths L of the two tabs 40 combined can make up a minority portion of the total circumference of the device 20. In some constructions, the combined lengths L of the two tabs 40 can make up between about 15 percent and about 45 percent, or between about 20 percent and about 40 percent, or between about 25 percent and about 35 percent of the total circumference of the device 20. It should also be noted that the side seams defined by the vertical or longitudinal hinge portions 28 extend fully along the respective tabs 40 in the axial direction. The structure of the hinge portions 28 in the area of the tabs 40 can be identical to that described above. In this way, the tabs 40 fold along the side seams together with the circumferential strip.

Figure 6:
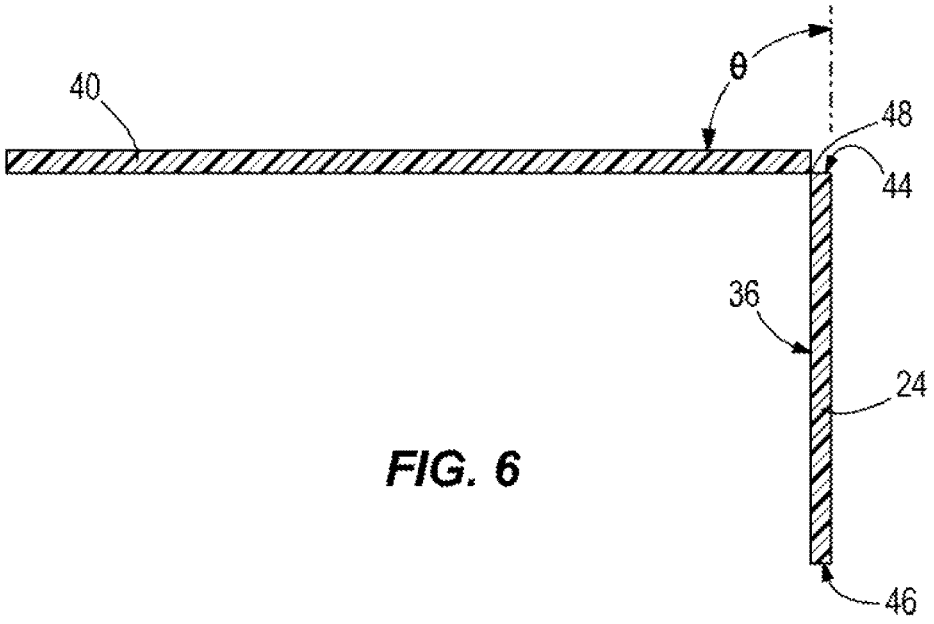
FIG. 6 is a cross-sectional view of a portion of the hold-open device, taken along line 6-6 of FIG. 5, to illustrate a living hinge connection of one of the tabs.

Each of the tabs 40 is coupled to the circumferential strip (i.e., the adjoining end sections of both of the side portions 24) with a respective hinge portion 48. The hinge portions 48 can extend along a generally circumferential direction, transverse or horizontal to the central axis A, although the length of each is only equal to that of the tab 40. The hinge portions 48 may also be referred to as horizontal or transverse hinges. In some constructions, the horizontal or transverse hinge portions 48 are living hinges. As best shown in FIG. 6, the hinge portions 48 can be formed by blind slits in the radially inward side to separate or interrupt the radially interior surface of the device 20 between the circumferential strip and tab portions. In other words, the horizontal or transverse hinge portions 48 are positioned at or adjacent a radially outermost side of the tabs 40 and the side portions 24. Each hinge portion 48 may form a continuous radially outer surface amongst the respective tab 40 and the adjacent side portions 24. When the hinge portions 48 are provided as living hinges, the tabs 40 can be integrally formed as a single piece with the circumferential strip (i.e., with both of the adjacent side portions 24), as a reduced-thickness portion of the material according to the materials and processes described above. The hinge portions 48 can be formed by a slitting operation performed after molding in some constructions. Alternately, the hinge portions 48 can be formed by die cutting, or directly in an injection molding process, or laser engraving process, among other possible techniques. The horizontal or transverse hinge portions 48 can have a material thickness less than 60 percent of a material thickness of the adjacent tab 40 and the adjacent portion of the circumferential strip 24. In some constructions, the horizontal or transverse hinge portions 48 can have a material thickness that is 50 percent or less, 45 percent or less, 40 percent or less, or 30 percent or less, or 25 percent or less, or 20 percent or less, or 10 percent or less, or 5 percent or less of a material thickness of the adjacent tab 40 and the adjacent portion of the circumferential strip 24. The material thickness of the hinge portions 48 can be between about 0.001 inch and about 0.040 inch (e.g., about 0.0254 mm to about 1.016 mm), or about 0.005 inch and about 0.030 inch (e.g., about 0.127 mm to about 0.762 mm), or about 0.010 inch and about 0.020 inch (e.g., about 0.254 mm to about 0.508 mm) in some constructions. In some constructions, the horizontal or transverse hinge portions 48 are provided by a separate material and/or multi-piece hinge mechanism coupled between the circumferential strip 24 and each tab 40. However, the hinge portions 48 may be provided as any portion that enables folding, bending, or pivoting. For example, the horizontal or transverse hinge portions 48 may be provided by only a fold or crease in the material.

Figure 13A:
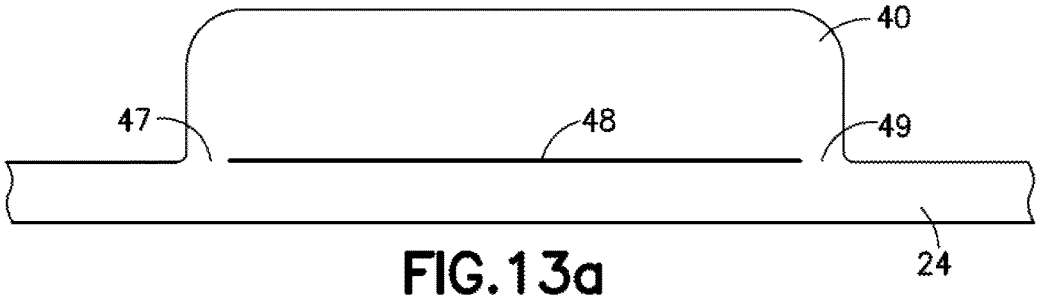
FIG. 13(*a-d*) is a top view of the hold open device depicting alternatives design for the transverse or horizontal hinge portion of the device.

In one form, the transverse or horizontal hinge portions 48 may have a cut length that is equal to the width of the tabs 40 (as for example in FIG. 7 and FIG. 10 and length "L" in FIG. 4A). That is the horizontal or transverse living hinge or blind slit transverses the entire width of the tabs 40. In another form, the transverse or horizontal hinge portions 48 may have a cut length for the blind slit or vertical living hinge 48 that is less than the width of the tabs 40. For example, there may be uncut areas 47, 49 as shown in FIG. 13 at each end of the tabs 40. Referring to FIG. 13*a*, in an alternative form, the horizontal or transverse living hinge or blind slit of the horizontal or transverse hinge portions 48 does not span the entire width of the tabs 40, which allows for a certain portion of uncut material 47, 49 on one end or both ends of the tabs 40. The portion of uncut material 47, 49 at the end of the tabs 40 may have a width of less than or equal to 5 mm, or less than or equal to 4 mm, or less than or equal to 3 mm, or less than or equal to 2 mm, or less than or equal to 1 mm, or less than or equal to 0.75 mm, or less than or equal to 0.5 mm. That is the cut length of the living hinge or blind slit of the horizontal hinge portions 48 spans the majority (greater than 50%, or greater than 60%, or greater than 70%, or greater than 80%, or greater than 90%) of the width (L in FIG. 4A) of the tabs 40 (see FIG. 13*a*). The living hinge or blind slit of the horizontal hinge 48 is cut from the inside side of the device in FIG. 13*a*. This alternative form of the horizontal hinge portions 48 including a cut length of the living hinge or blind slit that does not span the entire width of the tabs 40 provides for enhanced durability of the horizontal hinge portions 48 by decreasing the propensity for tearing or breaking of the tabs 40 from the strip 24 due to repeated use and flexing back and forth between the open and closed positions. That is that uncut material 47, 49 on one or both ends of the tabs 40 provides strength and reinforcement to the horizontal hinge portions 48 by preventing the horizontal hinge portions 48 from tearing from the strip 24 when being sheared or pulled in tension when the tabs 40 are in an upright or bent configuration. The relatively narrow width of the uncut material 47, 49 also still allows the horizontal hinge portions 48 to freely rotate. This alternative form of the horizontal hinge portions including a cut length of the living hinge or blind slit 48 that does not span the entire width of the tabs 40 provides for enhanced performance of the horizontal hinge portions 48 by providing a means by altering the width of the uncut width 47, 49 on each end of the tab 40 for tailoring the force required for folding, bending, or pivoting of the horizontal hinge portions 48.

Figure 13B:
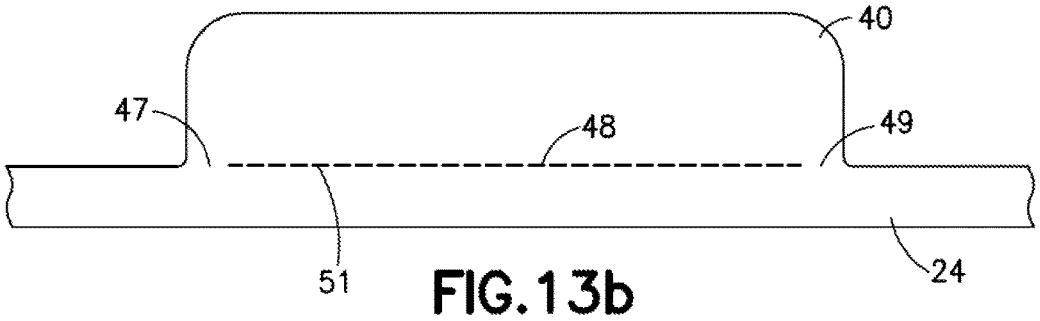

Referring to FIGS. 13*b*, *c* and *d*, in another alternative form, the transverse or horizontal hinge portions 48 may be in the form of a line of perforations (51 in FIG. 13*b*) or thru cuts (52 in FIG. 13*c*) that goes through (also alternatively referred to as "cuts through" or "passes through") the entire material thickness of the adjacent portion portions of the circumferential strip 24 and the tabs 40. The line of perforations is a series or multitude of cuts in a line that go through the entire material thickness of the adjacent portion portions of the circumferential strip 24 and the one or more tabs 40. The line of perforations may be in the form of dotted lines (53 in FIG. 13*d*), dashed lines (51 in FIG. 13*b*) or any other form that produces a line of a series of cuts or perforations that 20 through the entire material thickness to form the horizontal or transverse hinge portions 48.

Figure 13C:
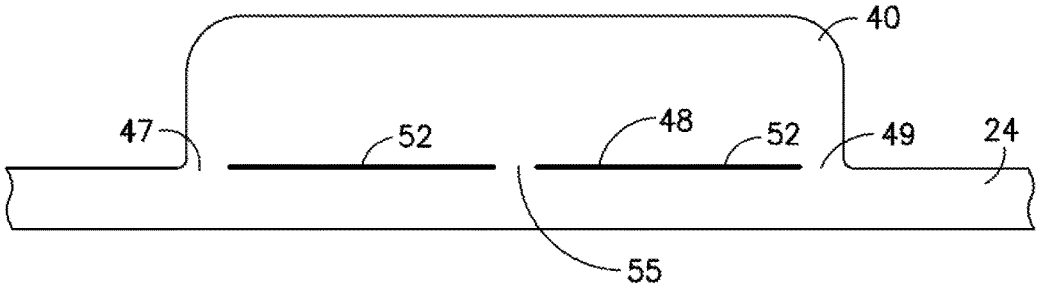
Figure 13D:
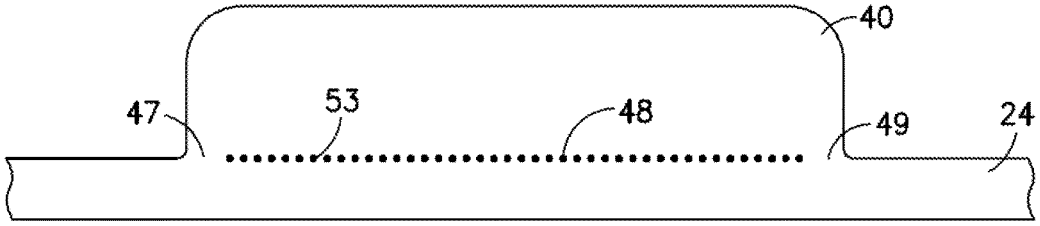

The thru cuts 52 are distinguished from the line of perforations (51 or 53) in being fewer longer cuts (typically two cuts 52 with an uncut section 55 in between the two cuts 52 as shown in FIG. 13*c*) in the material as opposed to shorter more frequent cuts with uncut regions in between for the line of perforations 51 53. The thru cuts 52 similarly go through the entire material thickness of the adjacent portion portions of the circumferential strip 24 and the one or more tabs 40. The two thru cuts 52 or line of perforations 51, 53 may extend for a majority of the width of the horizontal hinge portions 48. A majority of the width means that at least 50%, or at least 60%, or at least 70%, or at least 80%, or at least 90% of the width of the horizontal hinge portion 48 or tab length ("L" in FIG. 4A) is cut, perforated or scored through the entire material thickness. In order to maintain the integrity of the hinge portions 48 against tearing or breaking, the two ends 47, 49 of the horizontal hinges 48 are not cut, scored or perforated.

This alternative form of the hinge portions 48 including thru cuts 52 or line of perforations 51, 53 provides for at least one of the following advantages: ease of manufacturing and enhanced performance of the horizontal hinge portions 48 relative to a blind slit or living hinge design. With regard to the ease of manufacturing, using a thru cut or a perforation design for the horizontal hinge portions 48, a single tool may be used to produce both the vertical hinges and horizontal hinges because both may be cut from the same side of the fitment or device. With regard to the enhanced performance of the horizontal hinge portions 48, the thin cuts 52 or line of perforations 51, 53 provides for an effective means to tailor the force required for folding, bending, or pivoting of the horizontal hinge portions 48. The thin cuts 52 or line of perforations 51, 53 that form the transverse or horizontal hinge portions 48 at the bottom of tabs 40 and the top of the strip 24 may be formed by die cutting, or directly in an injection molding process, or laser engraving process, among other possible techniques. The thru cuts 52 or line of perforations 51, 53 that extend for a majority of the width of the tab 40 and hinge portions 48 also includes uncut material 47, 49 on one or both ends of the tabs 40. The portion of uncut material 47, 49 at the end of the tabs 40 may have a width of less than or equal to 5 mm, or less than or equal to 4 mm, or less than or equal to 3 mm, or less than or equal to 2 mm, or less than or equal to 1 mm, or less than or equal to 0.75 mm, or less than or equal to 0.5 mm. Again this uncut material 47, 49 on one or both ends of the tabs 40 provides strength and reinforcement to the horizontal hinge portions 48 by preventing the horizontal hinge portions 48 from tearing when being sheared or pulled in tension when the tabs 40 are in an upright or bent configuration. The relatively narrow width of the uncut material 47, 49 also still allows the horizontal hinge portions 48 to freely rotate.

Figure 5:
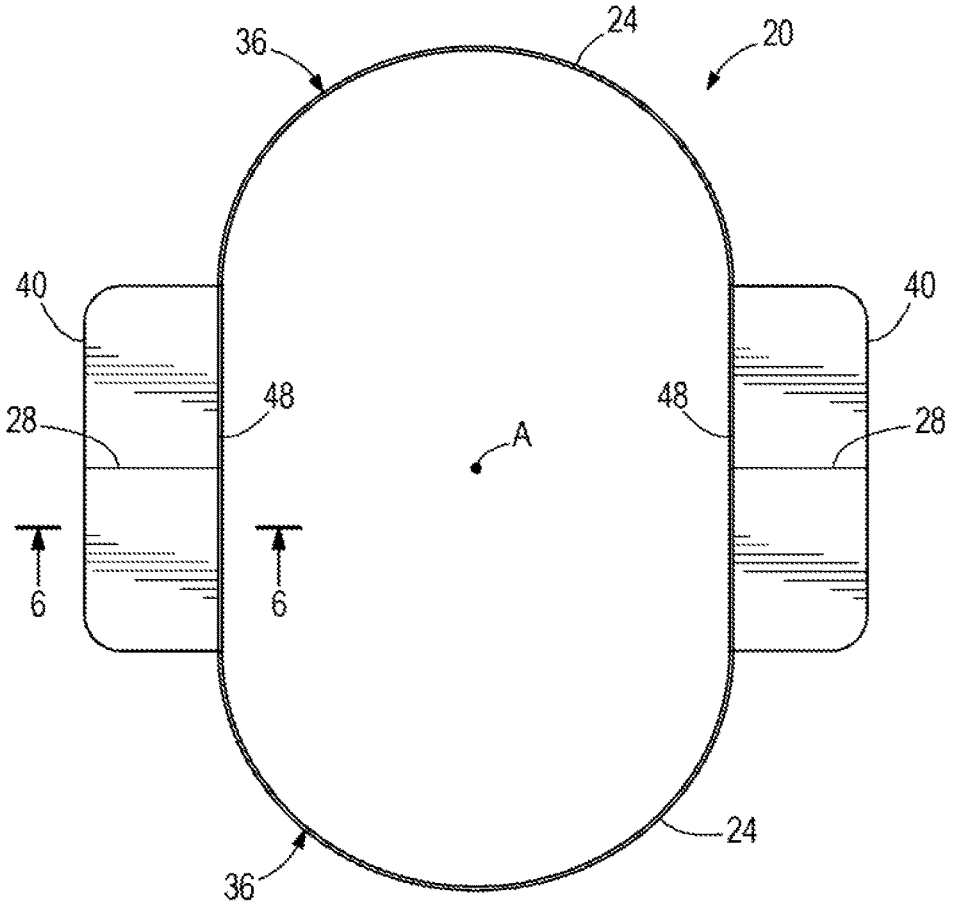
FIG. 5 is a top view of the hold-open device of FIG. 1, shown locked in a fully-open or gaping configuration by a pair of opposed end tabs that are folded outward.

The tabs 40 are foldable or pivotable in opposite directions away from the central axis A about their respective horizontal hinge portions 48 to respective folded-out positions, as shown in FIGS. 5-7. The horizontal hinge portions 48 can enable the folding of each tab 40 relative to the circumferential strip about an opening angle θ as defined in FIG. 6. The tabs 40 can fold from an extended or unfolded position (i.e., an opening angle θ of about 0 degrees) to a fully folded position (i.e., an opening angle θ of about 90 degrees). In some constructions, the hinge portions 48 may physically enable folding of the tabs 40 to more or less than 90 degree opening angles, but 90 degrees defines the point of maximum outward extension, and is thus referenced as "fully" folded. In general, a folded position may be defined as reaching an opening angle θ of greater than 45 degrees or greater than 60 degrees. As will be appreciated by the following description, the purpose of folding the tabs 40 to an outward position is to effectively inhibit or prevent folding of the circumferential strip at the side seams toward the closed configuration.

The horizontal hinge portions 48 delineating the tabs 40 intersect the hinge portions 28 that define the side seams. As shown, the respective vertical and horizontal hinge portions 28, 48 intersect at substantially 90 degree angles (e.g., perpendicular). Due to the intersection and the configuration of the vertical and horizontal hinge portions 28, 48, the device can either be folded closed about the side seams (i.e., vertical hinge portions 28) or the tabs 40 can be folded out about the horizontal hinge portions 48, but not both at the same time as the folding out of the tabs 40 upsets the continuity or linearity of the side seam vertical hinge portions 28 enough to prevent folding of the device about the side seams. In effect, the folding of the tabs 40 forces the side seams into a straight configuration where ends of the two side portions 24 combine to form a substantially flat or straight line section. Meanwhile, the portions of the circumferential strip that are not in overlapping arrangement with the tabs 40 are free to flex and assume a curved or arcuate shape as shown in FIGS. 5 and 7. Although the exact shape of the device 20 in the fully open configuration is at least somewhat variable as desired, it is generally formed by two opposed flat sections in the area of the side seams, connected by two opposed arcuate portions. The shape of the device 20 in the fully open configuration can approach circular as the length of the flat sections is reduced. Even when the device 20 does not open into a circular shape, it defines a wide-open or gaping configuration in which the cross-sectional area is very large, and near a maximum possible cross-sectional area for a given perimeter length. For example, the cross-sectional area of the opening defined by the device 20 in the fully open configuration may be at least 50 percent, or at least 75 percent, or at least 90 percent of the maximum possible cross-sectional area for a given perimeter length.

To produce a package 60 as shown in FIG. 7, the device 20 can be secured to a package body 70 having flexible sides 72, a closed end 74, an openable end 76, and a pair of side seams 78. The package 60 can be a multi-configurational package, which has at least one stable wide-open configuration provided by the device 20 (e.g., in the configuration of FIG. 5 as shown), in addition to one or more configurations in which the openable end 76 is not held wide-open by the device 20. The package body 70 can be constructed from a thin film or sheet of thermoplastic polymer, but other materials may also be used. All or a portion of the circumferential strip may be positioned along the interior surface of the package body 70, such that all or majority portions of the tabs 40 protrude outside the end 76 of the package body 70 to facilitate folding. The device 20 can be secured to the package body 70 in any number of suitable ways such as adhesively bonded, heat sealed, solvent or chemical welding. Such securing may be deemed permanent securement, which is intended for the life of the package 60.

The package body 70 can be provided with a resealable closure 82 (e.g., a pressure type zip closure, a slide type zip closure, Velcro™ type closure, etc.) to seal in the contents of the package 60 away from the surrounding environment. Other types of closures 82 are optional, and in some constructions, the package 60 can be provided with a closure that is not resealable or no closure at all. As shown in FIG. 7, the resealable closure 82 is positioned proximate the openable end 76, with the device 20 situated therebetween. The device 20 is arranged in the package body 70 such that the side seams of the device 20, as defined by the vertical hinge portions 28, are substantially aligned with the side seams 78, so that the device 20 is capable of folding closed or flat along with the package body 70. When the resealable closure 82 is released, the device 20 can optionally be manipulated to hold the openable end 76 in a gaping configuration that provides easy access into the interior of the package 60.

In a first configuration, the package 60 is in a closable state in which the vertical hinge portions 28 of the device 20 are folded. In this configuration, the resealable closure 82 may be manipulated to a closed state and the device 20 does not interfere with closing or sealing of the package 60. Folding along the vertical hinge portions 28 substantially prevents the horizontal hinge portions 48 of the tabs 40 from being folded outward as they are folded upon themselves. In a second configuration, the package 60 is held open by the device 20, with the tabs 40 being folded outwardly along the respective horizontal hinge portions 48 to substantially prevent folding along the vertical hinge portions 28. In this configuration, the tabs 40 themselves are in a generally flat, unfolded state (i.e., not folded on themselves about the hinge portions 28). To put the device 20 and the package 60 into the second configuration, the tabs 40 are simply grasped and folded outward. From a closed or nearly-closed configuration, the side seams will first be brought toward one another to enable folding the tabs 40 outward. From the second configuration, the user folds the tabs 40 back toward the first direction B, whereby the device 20 can then fold along the side seam vertical hinge portions 28.

Figure 9:
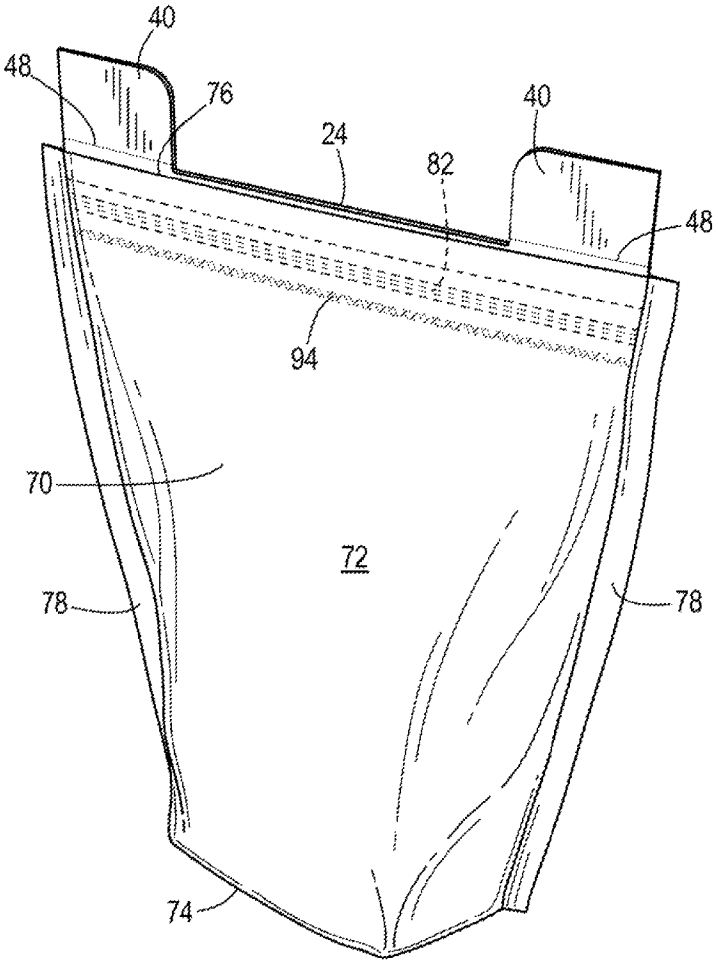
FIG. 9 is a perspective view of the package of FIG. 8, shown with the header strip removed to expose the tabs of the hold-open device.
Figure 8:
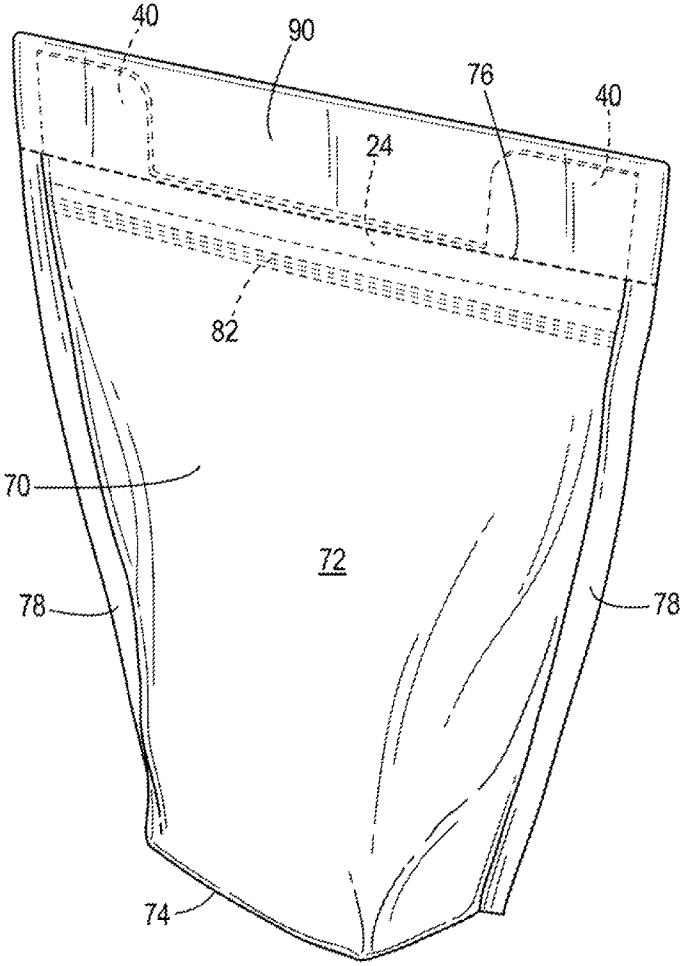
FIG. 8 is a perspective view of a package including the hold-open device of FIGS. 1-6 and provided with a hermetically-sealed header strip for a store shelf configuration prior to initial use.

FIG. 8 illustrates the package 60 in a "store shelf" configuration prior to initial use. In other words, this configuration may be the final manufactured configuration of the package 60, including its designated contents, which have not been accessed by a consumer or end user. As such, the package 60 includes a header 90 that provides an air-tight or hermetic seal regardless of the status of the resealable closure 82. The header 90 can be formed as an integral portion of the package body 70, and can be easily removed via tearing (e.g., along a predetermined line of weakening, such as by scoring or partial perforations). The header 90 can enclose the device 20, including the tabs 40. Upon removal of the header 90, the tabs 40 are accessible, and the user can operate the resealable closure 82 and the device 20 as described above. In an alternate construction shown in FIG. 9, an air-tight or hermetic seal can be provided without the use of a header 90. Rather, a seal 94 is provided directly between the opposing flexible sides 72 of the package body 70, just below (i.e., to the interior side of) the device 20 and the resealable closure 82.

FIG. 10 illustrates a device 120 according to an alternate construction. The device 120 is similar to the device 20 of FIGS. 1-9, except as specifically described. In addition to the tabs 40, which extend from the circumferential strip in the first direction B parallel to the central axis A (when the device 120 is folded about the side seams), the device 120 includes at least one projection 125 substantially aligned with one of the tabs 40 and extending from the circumferential strip in a second direction C opposite the first direction B. In some constructions, a projection 125 is positioned in alignment with each of the tabs 40. The projections 125 can have a circumferential dimension similar to that of the tabs 40. Each projection 125 includes a substantially flat lower edge 127. When the device 120 is secured to a package body, the flat lower edge 127 of the projection 125 is positioned generally within the interior of the package, and this allows a user to run a measuring scoop along the edge 127 to obtain a consistent measure of a substance stored within the package (e.g., coffee grounds, flour, sugar, etc.).

Figure 11:
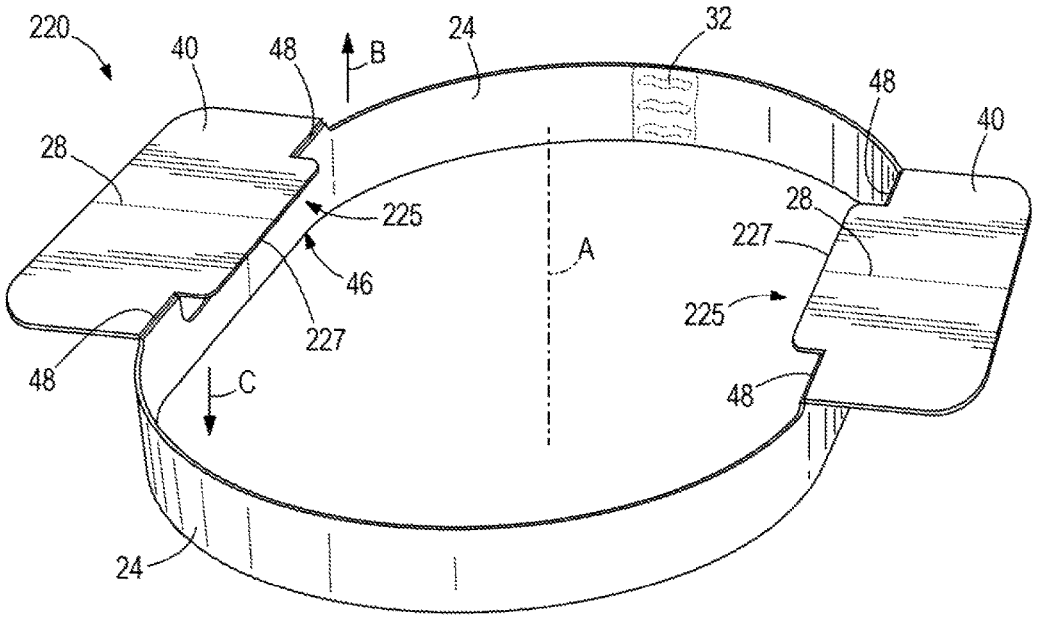
FIG. 11 is a perspective view of a hold-open device according to yet another construction.

FIG. 11 illustrates a device 220 according to another alternate construction. The device 220 is similar to the device 120 of FIG. 10, except as specifically described. The device 220 includes at least one projection 225 providing a substantially flat lower edge 227. When the device 220 is secured to a package body, the flat lower edge 227 of the projection 225 is positioned generally within the interior of the package, and this allows a user to run a measuring scoop along the edge 227 to obtain a consistent measure of a substance stored within the package (e.g., coffee grounds, flour, sugar, etc.) similar to the device 120 of FIG. 10. However, in the device 220, the projections 225 are integrally formed to extend directly from the tabs 40. The projections 225 are thus positioned above the base end 46 of the circumferential strip, but are able to extend into the interior of the package by way of having free ends separated (e.g., cut) from the circumferential strip. In this way, the projections 225 move directly with the tabs 40, and may pivot between a retracted or non-operable position (not shown) and an extended operable position as shown. The projections 225 only extend in the direction C when the tabs 40 are upright and not folded out about the hinge portions 48. The tabs 40 formed with the projections 225 as shown in FIG. 11 causes the hinge portion 48 for each individual tab 40 to be divided into two separate segments.

Figure 14A:
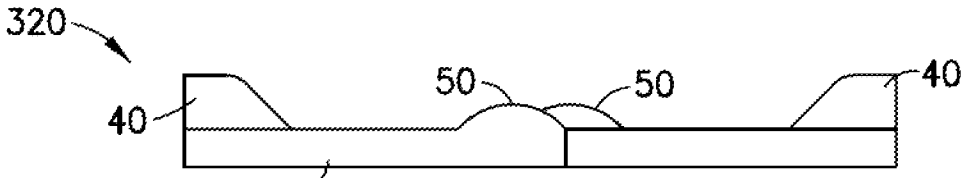
FIG. 14(*a-c*) is a top view of the hold open device including a pair of offset pouch opening segments.
Figure 14B:
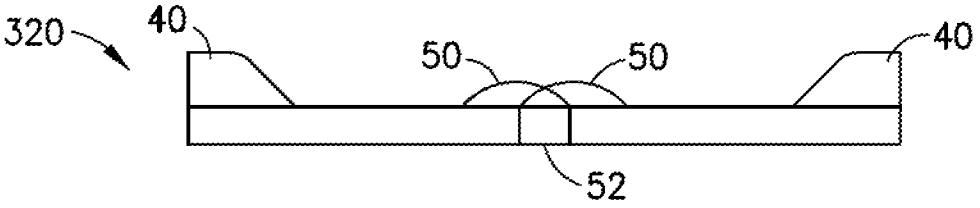
Figure 14C:
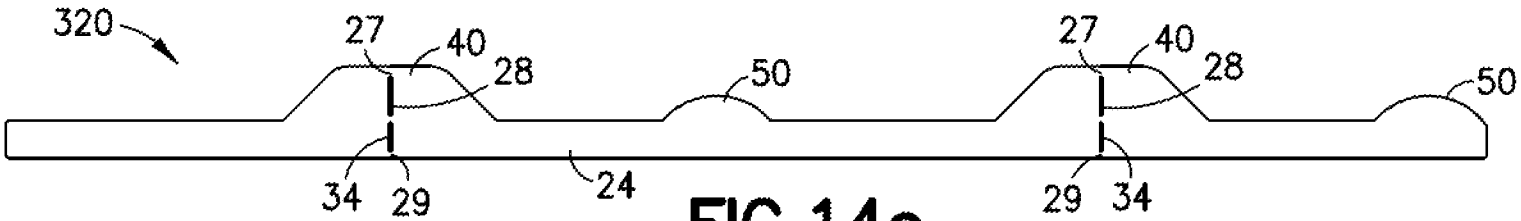

The hold open device disclosed herein may optionally include a pair of pouch opening segments extending from the top of the strip of the device that are used to facilitate the opening and closing of the device and correspondingly the pouch. Referring to FIG. 14, the device 320 includes a pair of pouch opening segments 50 extending from the top of the strip 24. The pair of pouch opening segments 50 may be of various shapes, including, but not limited to, semi-circular (as shown in FIG. 14), square, rectangular, trapezoidal, triangular, elliptical, and parallelogram. The pair of pouch opening segments 50 are located generally about midway between the tabs 40 of the device 320 such that they are located close to center of the package (about midway between side edges of the package). Each of the pouch opening segments 50 may completely overlap with one another (not shown in FIG. 14) when the device 320 is in the closed position. More preferably, each of the pouch opening segments 50 is slightly offset from one another when the device 320 is in the closed position to facilitate the gripping and handling of the segments because without an offset it is difficult to grasp the pair of pouch opening segments 50. The offset 52 between the pair of the pouch opening segments 50 may be measured as the length or distance 52 between the center point of each of the pouch opening segments 50 when the device 320 is in the closed position. This offset 52 may be 30 mm or less, or 25 mm or less, or 20 mm or less, or 15 mm or less, or 10 mm or less, or 5 mm or less, or 3 mm or less. Alternatively, the offset 52 between the pair of the pouch opening segments 50 may be measured as the percentage of the width of one pouch opening segment that does not completely overlap with the second pouch opening segment 50. The offset may be at least 10%, or at least 20%, or at least 30%, or at least 40% of the width of the pouch opening segment 50. The offset 52 between each of the pouch opening segments 50 makes it easier to separate them when the device 320 is moved from the closed to the open position. The pair of pouch opening segments 50 are an extension of the strip 24 and do not include any type of hinge at the intersection of the pouch opening segment 50 and the strip 24. FIGS. 14*a* and 14*b* depict the device 320 in the closed configuration. FIG. 14*c* depicts the device 320 in the open position. In FIG. 14*c* are also shown vertical or longitudinal hinges 28 for the tabs 40 in the form of thru cuts 34.

Figures 15A, 15B, 15C, 15D, 15E:
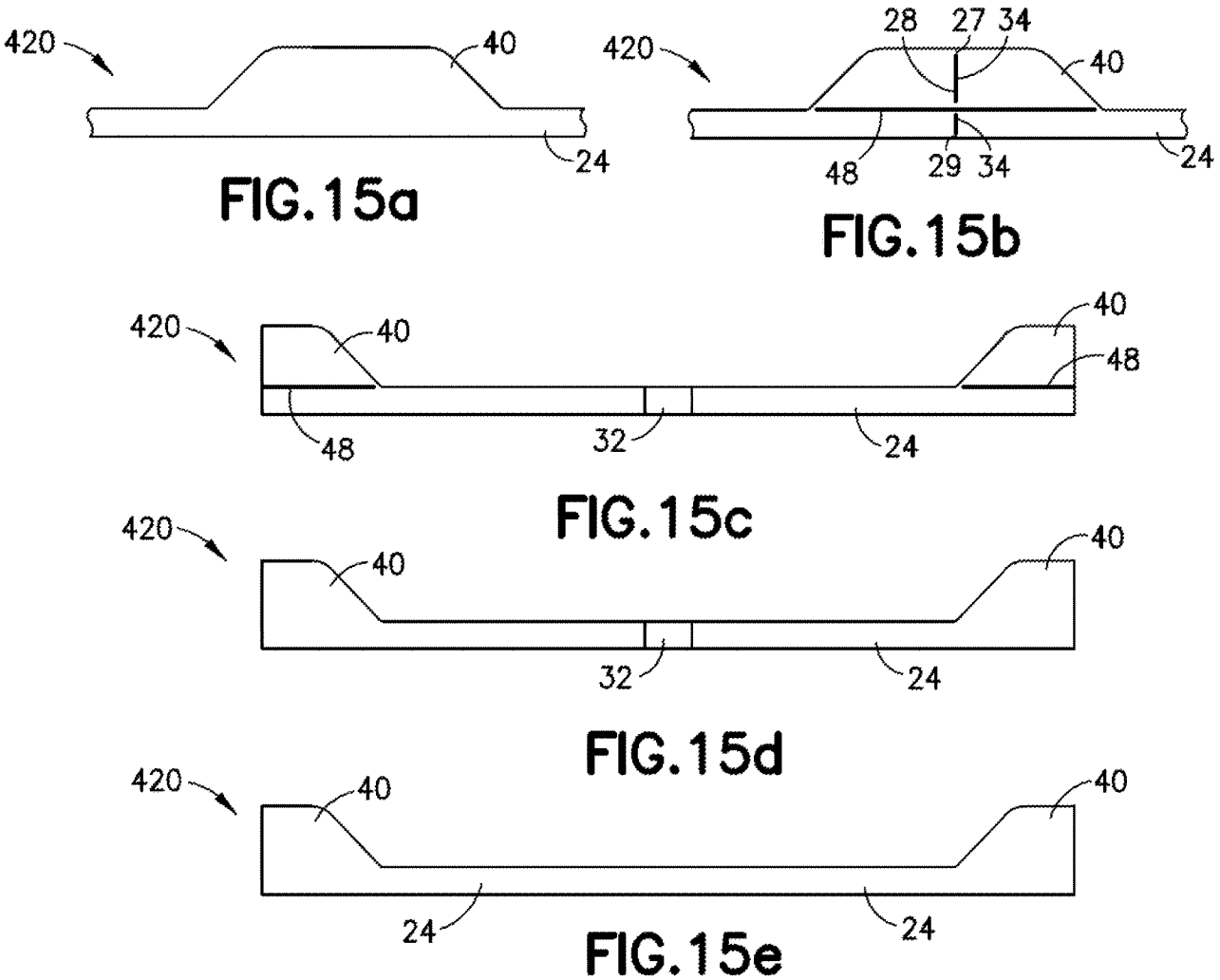
FIG. 15(*a-e*) is a top view of the hold open device depicting alternative shapes for the tabs of the device.

The tabs 40 of the hold open device may be of various shapes, including, but not limited to, rectangular (as shown in FIGS. 1-2, 5, 7, 8-11, and 12-13), semi-circular, square, rectangular, triangular, elliptical, trapezoidal, and parallelogram. Referring to FIG. 15, depicted are alternate shapes or profiles for the tabs 40 of the device 420. FIG. 15*a* depicts the device 420 with tabs 40 that are in the shape of a trapezoid. FIG. 15*b* depicts the device 420 with trapezoidal shaped tabs 40 and vertical or longitudinal hinges 28 for the tab 40 in the form of thru cuts 34 and horizontal or transverse hinges 48. FIG. 15*c* depicts the device 420 with trapezoidal shaped tabs 40 and horizontal or transverse hinges 48 for the device 420 in the form of a living hinge and a bond 32 joining distal ends of the strip 24 together. FIG. 15*d* depicts the device 420 with trapezoidal shaped tabs 40 and a bond 32 joining distal ends of the strip together. FIG. 15*e* also depicts the device 420 with trapezoidal shaped tabs 40.

Although not shown, any of the devices described herein and shown in the drawings may be modified with more or fewer side seams and tabs. For example, a device may be constructed that is identical to any of the illustrated devices with the exception of the removal of one of the tabs and the horizontal hinge portion coupling that tab. Although the stable hold-open configuration may then not have a shape as shown in FIG. 5, the interaction between the remaining tab and the side seam intersecting that tab is similar to that described above in such a construction, to selectively enable and inhibit folding of the device (and likewise a package connected thereto) at the side seam. It is also noted that the devices as otherwise described above may be provided with a non-circumferential strip portion coupled to each individual tab as opposed to the circumferential strip as shown. For example, a strip portion may be provided below each tab, but not extending to connect with the strip portion associated with an opposing tab. The strip portion can extend along the package opening with a length similar to the connected tab, or slightly more or less. In this way, one or more devices may be separately secured to a flexible package body proximate (e.g., extending across) one or more corresponding side seams of the package body. Even a single-tab device applied at one package crease or seam can be operated to selectively maintain the opening in a gaping configuration, as it will inhibit folding of the opening at that seam.

The devices 20, 120, 220, 320, 420 described herein may be used in conjunction with any variety of closure mechanisms and packaging formats including sachet and stand-up style pouches, for example. Each of the devices 20, 120, 220, 320, 420 can be manufactured as a fitment where each unit is applied to a package body (e.g., a pre-formed package body) as part of an assembly process or as a tape where the mechanisms are applied in conjunction with horizontal form fill seal (HFFS) or vertical form fill seal (VFFS) machinery used to form, fill and seal flexible packages.

What is claimed is:

1. A device for selectively retaining a package opening in a gaping configuration, the device comprising:

a circumferential strip configured to be secured to a package opening, the circumferential strip defining an opening axis;

a pair of side seams formed as vertical hinges, wherein the pair of side seams define opposed first and second ends of the device, the device being divided by the pair of side seams into first and second sides; and a pair of tabs extending in a first axial direction from an upper edge of the circumferential strip, one of the pair of tabs being positioned at each of the opposed first and second ends of the device, each one of the pair of tabs being coupled to the circumferential strip with a horizontal hinge, the pair of tabs being pivotable about the horizontal hinges in opposite directions away from the opening axis to respective folded-out positions, wherein each one of the pair of side seams intersects a corresponding one of the horizontal hinges of the pair of tabs such that folding of the device at the side seams inhibits pivoting of the pair of tabs to the respective folded-out positions, and folding of the device at the side seams is inhibited to retain a gaping open configuration of the device when the pair of tabs are in the respective folded-out positions, and wherein the vertical hinges include thru cuts or a line of perforations that go through the entire material thickness of the adjacent portion of the circumferential strip and the pair of tabs, and wherein the thru cuts or line of perforations extend for a majority of the full axial length of the device, from upper ends of the pair of tabs to a lower end of the circumferential strip.

2. The device of claim 1, wherein the pair of side seams extend substantially parallel to the opening axis.

3. The device of claim 2, wherein the horizontal hinges of the pair of tabs extend substantially circumferentially and substantially perpendicular to the opening axis.

4. The device of claim 1, wherein the majority of the full axial length of the device is at least 50% of the height or length of the side seams.

5. The device of claim 1, wherein the line of perforations are in the form of dotted lines or dashed lines.

6. The device of claim 1, wherein the pair of side seams intersect the respective horizontal hinges of the pair of tabs at substantially 90-degree angles.

7. The device of claim 1, further comprising at least one projection substantially aligned with one of the pair of tabs in the circumferential direction and extending in a direction opposite the first axial direction.

8. The device of claim 1, wherein the horizontal hinges of the pair of tabs comprises a living hinge located at a radially outward side of the device and formed by a blind slit from a radially inward side of the device.

9. The device of claim 8, wherein the living hinge has a material thickness that is 80 percent or less of adjacent portions of the circumferential strip and the corresponding one of the pair of tabs.

10. The device of claim 9, wherein the living hinge has a material thickness that is 25 percent or less of adjacent portions of the circumferential strip and the corresponding one of the pair of tabs.

11. The device of the claim 1, wherein the horizontal hinges of the pair of tabs comprises thru cuts or a line of perforations that go through the entire material thickness of the adjacent portions of the circumferential strip and each of the pair of tabs.

12. The device of claim 1, wherein the horizontal hinges of the pair of tabs do not span the entire width of the tabs.

13. The device of claim 12, wherein the horizontal hinges of the pair of tabs include an uncut segment on one end or both ends of each of the pair of tabs, wherein the uncut segment has a width of less than or equal to 5 mm.

14. The device of claim 12, wherein the horizontal hinges extend for a majority of the width of the pair of tabs.

15. The device of claim 14, wherein the majority of the width is at least 50% of the width of the tabs.

16. The device of claim 1, wherein the vertical hinges include an uncut segment on one end or both ends of the vertical hinges, wherein the uncut segment has a width of less than or equal to 5 mm.

17. The device of claim 1 made from a single piece with distal ends, and wherein the distal ends are joined to form a bond provided in the circumferential strip at an intermediate location along one of the first and second sides, spaced from both of the pair of side seams.

18. The device of claim 17, wherein the single piece with distal ends is formed from a thermoplastic polymer material via injection molding or extrusion followed by die cutting.

19. The device of claim 18, wherein the thermoplastic polymer material is selected from the group consisting of polypropylene, polyethylene, polybutylene and blends thereof.

20. The device of claim 17, wherein the bond provided in the circumferential strip is formed by adhesive bonding, heat sealing, spot sealing or sonic welding.

21. The device of claim 1, further including a pair of pouch opening segments extending in a first axial direction from an upper edge of the circumferential strip, wherein each pouch opening segment is positioned about midway between each of the opposed first and second ends of the device and wherein each pouch opening segment is positioned on the opposite side of the circumferential strip from the other pouch opening segment.

22. The device of claim 21, wherein the pair of pouch opening segments completely overlap one another when the device is in the closed position.

23. The device of claim 21, wherein the pair of pouch opening segments are offset from one another by at least 3 mm when the device is in the closed position.

24. The device of claim 21, wherein the pair of pouch opening segments are of a shape selected from the group consisting of semi-circular, square, rectangular, trapezoidal, triangular, elliptical, and parallelogram.

25. The device of claim 1, wherein the pair of tabs are of a shape selected from the group consisting of semi-circular, square, rectangular, trapezoidal, triangular, elliptical, and parallelogram.

26. A package comprising:

a package body including flexible sides, a closed end, an openable end, and a pair of side seams; and a device for selectively retaining the openable end of the package body in a gaping configuration, the device including a circumferential strip secured to the package body at the openable end, the circumferential strip defining an opening axis coaxial with a package body axis, a pair of side seams aligned with the pair of side seams of the package body, the pair of side seams of the device being formed by vertical hinges, and a pair of tabs extending in a first axial direction from an upper edge of the circumferential strip, one of the pair of tabs extending across each one of the side seams of the device, each one of the pair of tabs being coupled to the circumferential strip with a horizontal hinge, the pair of tabs being pivotable in opposite directions away from the opening axis about the horizontal hinges to respective folded-out positions, wherein the vertical hinges include thru cuts or a line of perforations that go through the entire material thickness of the adjacent portion portions of the circumferential strip and the pair of tabs, and wherein the thru cuts or line of perforations extend for a majority of the full axial length of the device, from upper ends of the pair of tabs to a lower end of the circumferential strip, wherein each one of the pair of side seams of the device intersects a corresponding one of the horizontal hinges of the pair of tabs such that folding of the device at its side seams inhibits pivoting of the pair of tabs to the respective folded-out positions, and folding of the device at its side seams is inhibited to retain a gaping open configuration of the device when the pair of tabs are in the respective folded-out positions, the package thus being operable in at least two configurations including a first configuration in which the device is folded upon its side seams and the openable end of the package body can be closed, and a second configuration in which the pair of tabs are both folded outward away from the opening axis about the respective horizontal hinges to inhibit closing of the openable end of the package body.

27. The package of claim 26, further comprising a resealable closure mechanism for selectively holding the openable end of the package closed.

28. The package of claim 27, wherein the resealable closure mechanism is positioned proximate the openable end with the circumferential strip positioned therebetween.

29. The package of claim 26, wherein the pair of tabs extend outwardly past the openable end of the package body in the first configuration.

30. The package of claim 29, further comprising a hermetically-sealed header coupled to the package body at the openable end, the header covering the pair of tabs and being severable from the package body to expose the pair of tabs and enable access to the package body through the openable end.

31. The package of claim 26, wherein the horizontal hinges of the pair of tabs extend substantially circumferentially and substantially perpendicular to the opening axis and the package body axis.

32. The package of claim 26, wherein the majority of the full axial length of the device is at least 50% of the height or length of the side seams.

33. The package of claim 26, wherein the line of perforations are in the form of dotted lines or dashed lines.

34. The package of claim 26, wherein the pair of side seams of the device intersect the respective horizontal hinges of the pair of tabs at substantially 90-degree angles.

35. The package of claim 26, further comprising at least one projection substantially aligned with one of the pair of tabs in the circumferential direction and extending in an inward direction into the package body.

36. The package of claim 26, further comprising a hermetic seal formed between the flexible sides of the package body, the hermetic seal being positioned adjacent the openable end, with the circumferential strip positioned therebetween.

37. The package of claim 36, further comprising a resealable closure mechanism operable to selectively hold the openable end of the package closed.

38. The package of claim 26, wherein the horizontal hinges of the pair of tabs is a living hinge located at a radially outward side of the device and formed by a blind slit from a radially inward side of the device.

39. The package of claim 38, wherein the living hinge has a material thickness that is 80 percent or less of adjacent portions of the circumferential strip and the corresponding one of the pair of tabs.

40. The package of claim 39, wherein the living hinge has a material thickness that is 25 percent or less of adjacent portions of the circumferential strip and the corresponding one of the pair of tabs.

41. The package of claim 26, wherein the horizontal hinges of the pair of tabs comprises thru cuts or a line of perforations that go through the entire material thickness of the adjacent portions of the circumferential strip and each of the pair of tabs.

42. The package of claim 26, wherein the horizontal hinges of the pair of tabs do not span the entire width of the tabs.

43. The package of claim 42, wherein the horizontal hinges of the pair of tabs include an uncut segment on one end or both ends of each of the pair of tabs, wherein the uncut segment has a width of less than or equal to 5 mm.

44. The package of claim 42, wherein the horizontal hinges extend for a majority of the width of the pair of tabs.

45. The package of claim 44, wherein the majority of the width is at least 50% of the width of the tabs.

46. The package of claim 26, wherein the vertical hinges include an uncut segment on one end or both ends of the vertical hinges, wherein the uncut segment has a width of less than or equal to 5 mm.

47. The package of claim 26, wherein the device is made from a single piece with distal ends, and wherein the distal ends are joined to form a bond provided in the circumferential strip at an intermediate location along one of the first and second sides, spaced from both of the pair of side seams.

48. The package of claim 47, wherein the single piece with distal ends is formed from a thermoplastic polymer material via injection molding or extrusion followed by die cutting.

49. The package of claim 48, wherein the thermoplastic polymer material is selected from the group consisting of polypropylene, polyethylene, polybutylene and blends thereof.

50. The package of claim 47, wherein the bond provided in the circumferential strip is formed by adhesive bonding, heat sealing, spot sealing or sonic welding.

51. The package of claim 26, further including a pair of pouch opening segments extending in a first axial direction from an upper edge of the circumferential strip, wherein each pouch opening segment is positioned about midway between each of the opposed first and second ends of the device and wherein each pouch opening segment is positioned on the opposite side of the circumferential strip from the other pouch opening segment.

52. The package of claim 51, wherein the pair of pouch opening segments completely overlap one another when the package is in the closed position.

53. The package of claim 51, wherein the pair of pouch opening segments are offset from one another by at least 3 mm when the package is in the closed position.

54. The package device of claim 51, wherein the pair of pouch opening segments are of a shape selected from the group consisting of semi-circular, square, rectangular, trapezoidal, triangular, elliptical, and parallelogram.

55. The package of claim 26, wherein the pair of tabs are of a shape selected from the group consisting of semi-circular, square, rectangular, trapezoidal, triangular, elliptical, and parallelogram.

56. A device for selectively retaining a package opening in a gaping configuration, the device comprising:

a strip portion configured to be secured to a package opening;

at least one tab extending from the strip portion;

a vertical hinge portion dividing the strip portion and the at least one tab into two sides, the vertical hinge portion allowing the two sides to be folded together about the vertical hinge portion, wherein the vertical hinge portion includes thru cuts or a line of perforations that go through the entire material thickness of the adjacent strip portion and the adjacent at least one tab and wherein the thru cuts or line of perforations extend for a majority of the full axial length of the device, from upper end of the at least one tab to a lower end of the strip portion; and a horizontal hinge portion coupling the tab to the strip portion, the horizontal hinge intersecting the vertical hinge portion and allowing the tab to pivot from a vertical orientation generally aligned with the strip portion to a folded-out position that is angled out of alignment from the strip portion, wherein the horizontal hinge portion comprises a living hinge located at a radially outward side of the device and formed by a blind slit from a radially inward side of the device or the horizontal hinge portion comprises thru cuts or a line of perforations that go through the entire material thickness of the adjacent strip portion and the at least one tab, wherein folding of the device along the vertical hinge inhibits pivoting of the at least one tab to the folded-out position, and folding of the device along the vertical hinge is inhibited when the at least tab is in the folded-out position.

57. The device of claim 56, and a package coupled thereto, the package having at least one openable end, which is secured to the strip portion of the device.

58. The device of claim 56, wherein the majority of the full axial length of the device is at least 50% of the full axial length of the device.

59. The device of claim 56, wherein the line of perforations in the vertical hinge portion and the horizontal hinge portion are in the form of dotted lines or dashed lines.

60. The device of claim 56, wherein the horizontal hinge portion does not span the entire width of the at least one tab.

61. The device of claim 60, wherein the horizontal hinge portion includes an uncut segment on one or both ends of the at least one tab, wherein the uncut segment has a width of less than or equal to 5 mm.

62. The device of claim 60, wherein the horizontal hinge portion extends for a majority of the width of the at least one tab.

63. The device of claim 62, wherein the majority of the width is at least 50% of the width of the at least one tab.

64. The device of claim 56, wherein the living hinge of the horizontal hinge portion has a material thickness that is 80 percent or less of adjacent portions of the strip portion and the corresponding at least one tab.

65. The device of claim 64, wherein the living hinge of the horizontal hinge portion has a material thickness that is 25 percent or less of adjacent portions of the strip portion and the corresponding at least one tab.

66. The device of claim 56, wherein the vertical hinge portion includes an uncut segment on one end or both ends of the vertical hinge portion, wherein the uncut segment has a width of less than or equal to 5 mm.

67. The device of claim 56, further comprising a bond provided in the strip portion at an intermediate location along one of the two sides, spaced from the vertical hinge portion.

68. The device of claim 56, further including a pair of pouch opening segments extending in a first axial direction from an upper edge of the strip portion, wherein each pouch opening segment is positioned about midway between each of the opposed first and second ends of the device and wherein each pouch opening segment is positioned on the opposite side of the strip portion from the other pouch opening segment.

69. The device of claim 68, wherein the pair of pouch opening segments completely overlap one another when the device is in the closed position.

70. The device of claim 68, wherein the pair of pouch opening segments are offset from one another by at least 3 mm when the device is in the closed position.

71. The device of claim 68, wherein the pair of pouch opening segments are of a shape selected from the group consisting of semi-circular, square, rectangular, trapezoidal, triangular, elliptical, and parallelogram.

72. The device of claim 56, wherein the at least one tab is of a shape selected from the group consisting of semi-circular, square, rectangular, trapezoidal, triangular, elliptical, and parallelogram.

73. The device of claim 56, wherein the at least one tab includes one tab.

74. The device of claim 56, wherein the at least one tab includes two tabs.

* * * * *